United States Patent [19]

Kurz et al.

[11] Patent Number: 4,556,160

[45] Date of Patent: Dec. 3, 1985

[54] ROLL HOLDER, PARTICULARLY FOR A ROLLED FLAT PRODUCT

[75] Inventors: Josef Kurz, Haigerloch; Andrea Stinglwagner, Bad Überkingen, both of Fed. Rep. of Germany

[73] Assignee: Kurz Kunststoffe GmbH, Haigerloch-Owingen, Fed. Rep. of Germany

[21] Appl. No.: 589,664

[22] Filed: Mar. 14, 1984

[30] Foreign Application Priority Data

Apr. 26, 1983 [DE] Fed. Rep. of Germany ..... 3314991

[51] Int. Cl.[4] ..... B65H 35/10

[52] U.S. Cl. ..... 225/67; 225/82; 242/55.2

[58] Field of Search ..... 225/67, 68, 72, 73, 225/82; 242/55.2

[56] References Cited

U.S. PATENT DOCUMENTS 2,234,818 3/1941 Bulman ..... 225/68
2,256,342 9/1941 Hope ..... 225/67
3,319,855 5/1967 Tucker et al. ..... 225/67

FOREIGN PATENT DOCUMENTS 348714 2/1979 Austria .
3376128 1/1976 Fed. Rep. of Germany .
3129889 2/1983 Fed. Rep. of Germany .

*Primary Examiner*—Frank T. Yost
*Assistant Examiner*—Hien H. Phan
*Attorney, Agent, or Firm*—Michael J. Striker

[57] ABSTRACT

A roll holder includes a base plate and two yokes pivotally supported on the base plate. One of the yokes is a suspension yoke having a free arm for holding a roll with a tape material thereon and another yoke is a braking yoke for braking the rotation motion of the roll when a portion of the material is to be torn-off from the roll. The braking yoke also has a free arm which overlaps the free arm of the suspension yoke and has a U-shaped cross-section so that the free arm of the suspension yoke without the roll thereon can be inserted into the free arm of the braking yoke and the roll holder can be folded.

16 Claims, 14 Drawing Figures

Fig. 8
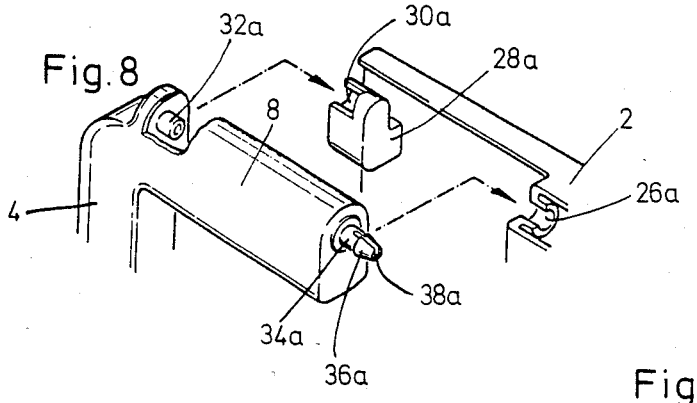
Fig. 9
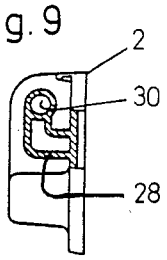
Fig. 12
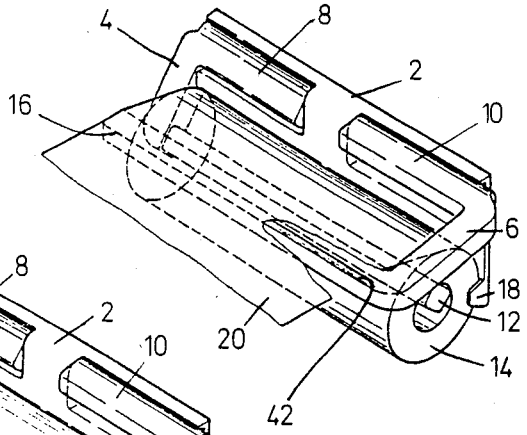
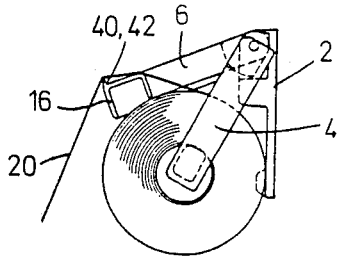
Fig. 10
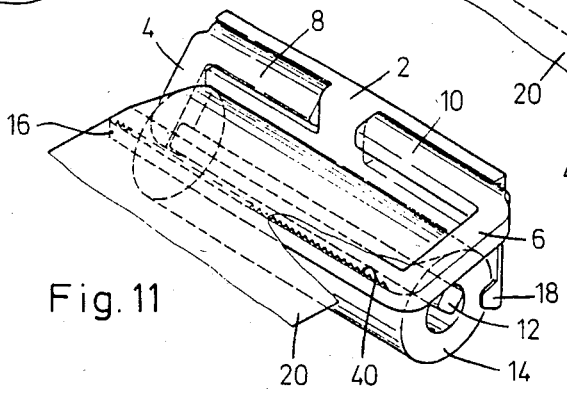
Fig. 11
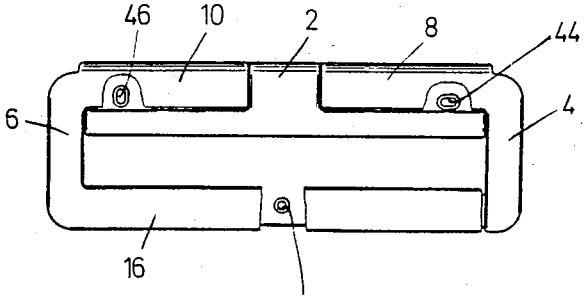
Fig. 13
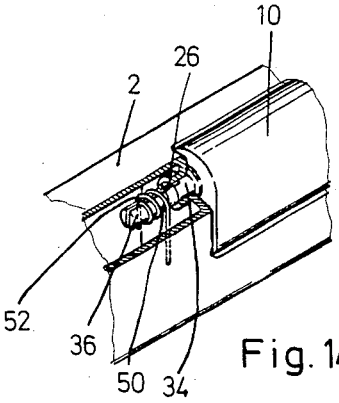
Fig. 14

ROLL HOLDER, PARTICULARLY FOR A ROLLED FLAT PRODUCT

BACKGROUND OF THE INVENTION

The present invention relates to a roll holder, particularly for a roll of a flat product to be rolled off from the roll.

Such roll holders may be utilized for paper, wadding, fleece, synthetic plastic foil, or aluminum foil. Conventional roll holders include a holding or suspension portion and a braking portion. The roll holders for the above-mentioned products are commonly used in the industry and in households. The tape-shaped product rolled in the roll is frequently subdivided in portions by means of perforation lines spaced at a predetermined distance from each other and extended transversal to the direction of rolling off of the flat product and weakening the product in the regions of perforations to facilitate a tearing-off of the product from the roll. In other instances, tear-off edges are provided on the flat product wound up on the roll.

In known tape roll holders, the rolled material is slidingly positioned on an extension shaft which can be either rigidly or movable supported on a base plate of the holder. In some cases, the shaft can be formed as a rigid or movable yoke open at one side thereof.

In order to prevent the roll mounted on the shaft from an uncontrolled further rotation during the tearing-off of the rolled product, friction of the roll against the base plate or a releasable pivotable cover on the roll can be used.

One of the conventional roll holders with means imparting to the roll a sufficient braking action is disclosed in DE-GM G No. 81 22 32.7. The roll material is mounted on the shaft which is supported at two sides thereof in lateral portions provided with downwardly running slots which are inclined to the back wall of the holder, and a second shaft is positioned in similar slots so that the pulled-over material tape of the roll moves this second shaft onto the upper surface of the roll and the tearing-off process is aided by the braking of the roll.

A danger, however, exists with this conventional tape roll holder that the freely supported axles can, during the operation, slide out from the guides so that the proper function of the holder would not be achieved. Furthermore, this known tape roll holder is comprised of at least three individual components, and simple operation instructions are required for laymen. Further more, two hands of the user are required for the insertion of the roll in the roll holder.

SUMMARY OF THE INVENTION

It is an object of the present invention to provide an improved flat product roll holder, which has no loseable components and which requires a very little space for a roll to be inserted in the holder.

It is a further object of this invention to provide a tape roll holder in which the entire operation process, including the insertion of the roll in the holder, can be carried out by one hand of the user.

These and other objects of the invention are attained by a roll holder, particularly for a roll of a flat product to be unrolled from the roll, comprising a base plate having an axis; a suspension yoke; and a braking yoke, each yoke being of U-shape cross-section and including a first arm extending in the direction of said axis of the base plate and pivotally supported thereon relative to said axis, and a second free arm, the free arm of said suspension yoke and the free arm of the braking yoke being positioned at an equal radial distance from said axis and overlapping each other, said suspension yoke and braking yoke having U-shaped lateral sides which are open in opposite directions.

In this arrangement, the roll slides on the inner free arm of the suspension yoke and the outwardly positioned free arm of the braking yoke lies on the outer surface of the roll to impart a braking action thereon. When the web of the material to be rolled-off from the roll is guided over the free arm of the braking yoke an enhanced braking action is produced during the tearing-off the required web, which action would prevent the roll from a further rotation.

According to a further feature of the invention, the free arm of the braking yoke has a U-shape cross-section enclosing a recess in which the free arm of the suspension yoke is insertable. Thereby, the roll holder is provided, which requires a minimum space when no roll is inserted in the holder and a nice appearance of the roll holder is warranted. Furthermore, the edges of the U-shaped arm of the braking yoke impart to the outer surface of the roll a stronger braking action than the smooth surface.

According to still another feature of the invention, the first arm of the suspension yoke and the first arm of the braking yoke are each shorter than the second free arm of each yoke and being positioned on the base plate in a common line one after another.

The holder may further include connecting pivot means for pivotally supporting the first arm of each yoke on said base plate, the connecting means of each yoke being positioned symmetrically to each other.

Furthermore, the connection pivot means of each yoke may have two pivot points, and include a first bearing formed in said base plate and located at one of said pivot points, a first bearing pin pivotally supported in said first bearing, a second bearing formed by a bearing block and located at said second point, and a second bearing pin pivotally supported in said bearing block.

The roll holder has an axis of symmetry; the first arm of each yoke may have an inner end and an outer end in respect to said axis of symmetry, said first bearing pin being disposed at said inner end and said second bearing pin being disposed at said outer end.

The bearing block may have a cylindrical recess receiving the second bearing pin.

The first bearing pin may have a cylindrical portion received in said first bearing and a truncated-conical portion of a greater diameter than that of the cylindrical portion and provided with a longitudinal slot extended centrally thereof up to a middle of said cylindrical portion, said truncate-conical portion passing through said first bearing and being snapped behind the latter.

This arrangement renders possible a simple manufacturing and assembly of the roll holder because each yoke can be inserted from outside into both bearings and a non-releasable locked position of each yoke on the base plate can be obtained by a light pressure exerted on the pivotable arm of each yoke, and due to the utilization of synthetic plastic materials a spring action of the slotted conical portion during inserting said portion into the bearing is warranted. Since the entire suspension point is in the mounted positon covered by outer walls of both yokes the pivot arrangement is not visible. The number of the required components parts is reduced to a minimum. The manufacturing of the roll holder is inexpensive and its assembling is very simple.

According to a still further feature of the invention, the first arm of each yoke has an upper side which may be formed with a projection, said base plate having a limiting rib, said projection of the first arm of each yoke being engageable behind said rib.

By a respective angular distribution of a number of cam-like projections on the arms of the yokes, the latter are arrested in a suitable position, and an exchange of an idle roll with a new one can be possible by one hand of the user. Preferably, the suspension yoke can be engaged with and arrested on the base plate at the angle of more than 45° in respect to the base plate and the braking yoke can be arrestable on the base plate at the angle of more than 90° to the base plate. After the insertion of a new roll into the holder, a slight pressure on both yokes is sufficient in order to release them from these arrested positions.

Furthermore, the base plate may be formed with a trapezoidal rib outwardly extended therefrom and provided in the region of the suspension yoke. A lateral removal of the roll from the holder over the open end of the suspension yoke is prevented by that trapezoidal rib.

The second free arm of the braking yoke may have an outer side formed with a series of projections. These projections may be tooth-shaped or blade-like. This feature of the invention simplifies tearing-off of the rolled material even without perforations thereon.

Furthermore, the base plate may be formed with three bores distributed over a triangle, one of the said bores being circular, and two of said bores being oblong with axes of elongation directed normally to each other. Due to this embodiment, the roll holder can be secured to the wall. Normally, the holder is secured to the wall with both yokes oriented in the horizontal direction so that the braking yoke is pushed by gravity against the suspension yoke.

The braking yoke may be loaded by a spring in the direction of said suspension yoke. With this embodiment, both yokes can be secured to the wall in any position, preferably vertical position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 8 is an exploded perspective view of the base plate and the suspension yoke;

FIG. 9 is a sectional view through the base plate with a bearing block shown in FIG. 7;

FIG. 10 is a side view of the roll holder in which the braking yoke is provided with paper-tearing blades;

FIG. 11 is a perspective view of the roll holder, in which the free arm of the braking yoke has tooth-shaped blades;

FIG. 12 is a perspective view of the roll holder, in which the free arm of the braking yoke has knife-shaped blades;

FIG. 13 is a front view of the roll holder with cutoffs to show bores for fastening the holder to a wall; and FIG. 14 is a partial perspective view of the braking yoke with a spring mounted in the arm of the yoke.

DETAILED DESCRIPTION OF THE PREFERRED EMBODIMENTS

Figure 1:
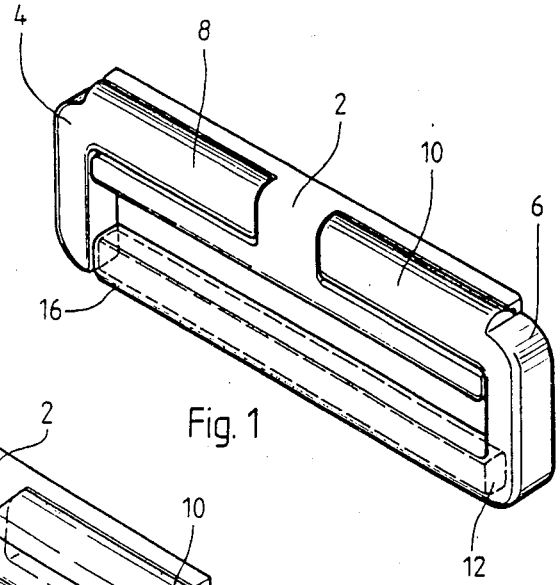
FIG. 1 shows a perspective view of the roll holder according to the invention, without a roll inserted therein.
Figure 2:
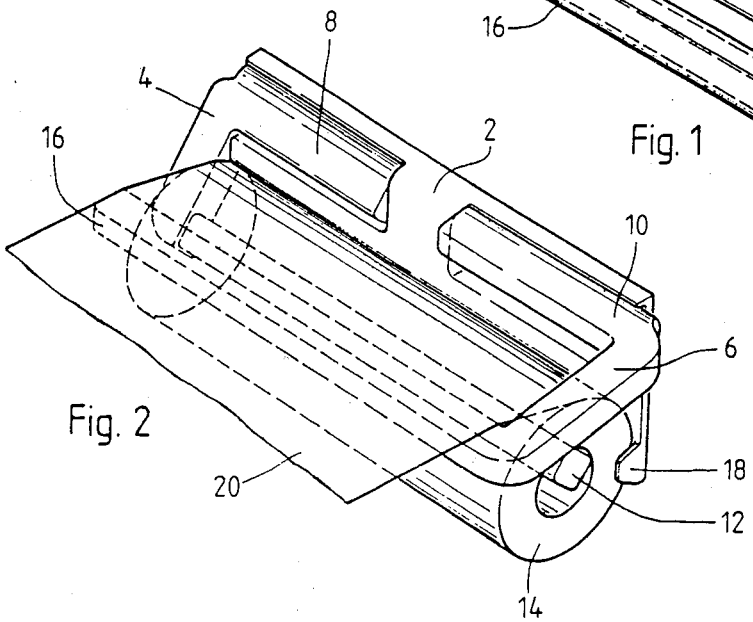
FIG. 2 is a perspective view of the roll holder of FIG. 1, with a paper roll inserted therein.
Figure 3:
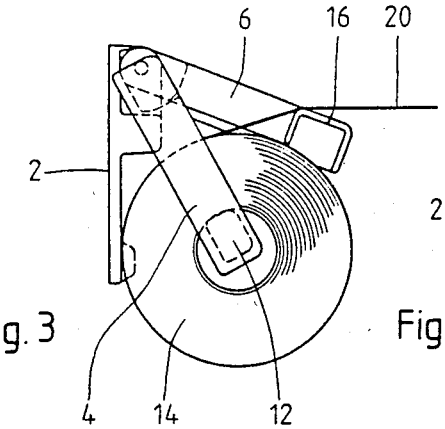
FIG. 3 is a side view, partially in section, of the roll holder with a paper roll in the rolling-off position.
Figure 4:
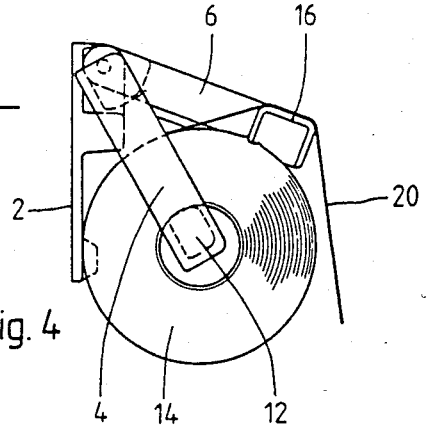
FIG. 4 is a side view of the roll holder of FIG. 3, but with a web of the paper roll in the tearing-off position.

Referring now to the drawings, and first to FIGS. 1, 3 and 4, the roll holder according to the invention includes a base plate or frame 2, at the middle upper portion of which a suspension yoke 4 and a braking yoke 6 are pivotally supported. Connecting elongated arms 8 and 10 of yokes 4 and 6, respectively are each somewhat shorter than the half of the entire width of the respective yoke, thereby arms 8 and 10 can be adjusted in respect to each other in the axial direction of base plate 2. Both yokes 4 and 6 have substantially U-shaped cross-section. The lower free arm of suspension yoke 4 is formed as an extension shaft 12, on which a tape roll, for example, paper roll 14 can be placed.

As best seen in FIG. 3, a free arm 16 of braking yoke 6 has U-shaped cross-section so that the wall of this yoke encloses a free interior space which is somewhat greater than the body of the extension shaft 12 which normally holds the paper roll thereon. Thereby, if a smaller paper roll is placed on extension shaft 12, the lower arm 16 of braking yoke 6 overlaps extension shaft 12 of suspension yoke 4 so that the shaft 12 and arm 16 lie in a common plane and a space requirement for a tape roll holder, which, for example is secured to a wall, is reduced to a minimum while a nice appearance of the holder is maintained.

Figure 5:
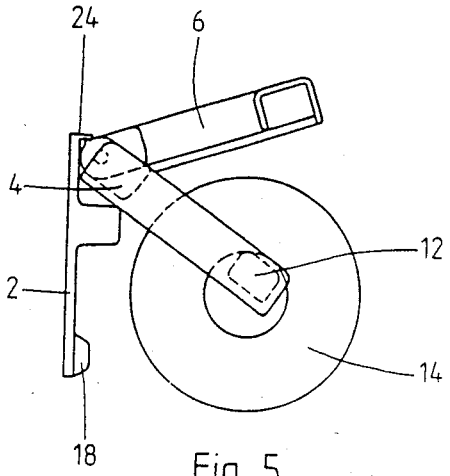
FIG. 5 is a side view of the roll holder with two yokes in a rest position, in which a roll is inserted into the holder.
Figure 6:
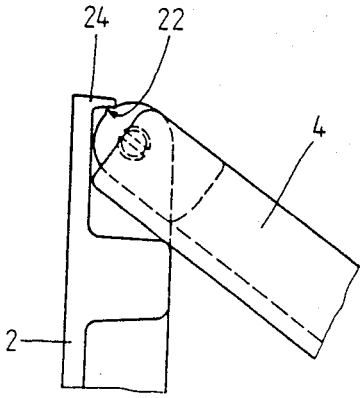
FIG. 6 is an enlarged partial side view of the suspension yoke in the rest position of FIG. 5.

In order to prevent a gradual lateral displacement of the paper roll 14 from the extension shaft 12, a trapezoidal rib 18 is provided on the side of base plate 2, which faces towards the open side of yoke 4 and in the region, in which the end of the extension shaft 12, free from the paper roll, is positioned. Paper roll 14 placed on extension shaft 12 is held behind rib 18. After engaging of the lateral side of paper roll 14 with rib 18 of base plate 2, the starting end of paper web 20 is guided over the free arm 16 of the braking yoke and the whole device is ready for operation. To permit the movement of paper roll 14 on the extension shaft 12 also by hand, as could be seen from FIGS. 5 and 6, the upper surfaces of the shorter arms 8 and 10 of both yokes 4 and 6 are provided with cam-like projections 22 whereas the upper portion of base plate 2 is formed with a limiting rib 24 which is engageable with cam-like projections 22 of yokes 4 and 6. The cam-like projection 22 of suspension yoke 4 is so arranged that this yoke in the suspended position, and when engaged with rib 24 of the base plate, includes with the vertical base plate 2 an angle which is somewhat greater than 45°. The angle included between the braking yoke 6 in its engaged position with rib 24 of base plate 2 and the plate 2 must be then more than 90°, as shown in FIG. 5, so that paper roll 14 can unobjectionally rotate on extension shaft 12. Since all portions of the tape roll holder are manufactured from elastic synthetic plastic material, the engagement and disengagement of both yokes 4 and 6 from the rib 24 can be carried out only by an overcoming of a comparatively small counterpressure.

Figure 7:
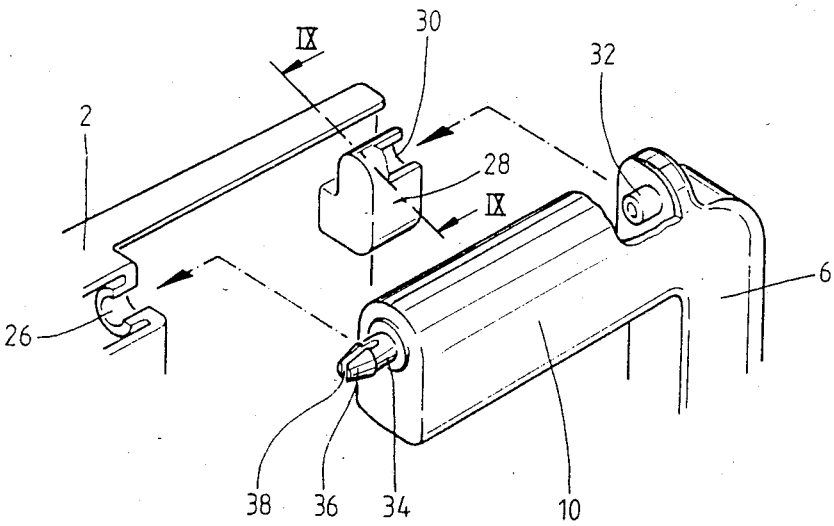
FIG. 7 is an exploded perspective view of the base plate and a braking yoke.

Each of the yokes 4 and 6 is supported in base plate 2 in two support joints and respective bearing elements are provided symmetrically for both yokes. With reference to FIG. 7, it will be seen that a bearing formed as an eyelet or projection 26 is provided for braking yoke 6 on the base plate 2. This eyelet 26 constitutes one bearing for the arm of the braking yoke, whereas another bearing for the arm 10 is formed by an L-shaped bearing block 28 having a cylindrical recess 30. Bearing block 28 is formed as an integral part of base plate 2 as seen from FIG. 9. The inner side of the shorter arm 10 of yoke 6, facing cylindrical recess 30, is provided with a bearing pin 32, which extends into recess 30. Another bearing pin, including a cylindrical portion 34, the diameter of which corresponds to that of the recess in projection 26, and an enlarged conical extension 36, projects outwardly from the face of arm 10 towards eyelet 26. An elongated slot 38 is formed centrally of the second bearing pin 34,36 in the axial direction thereof, which slot extends up to about the middle of cylindrical portion 34. During the assembly of the tape roll holder according to the invention, both bearing pins of shorter arms 8 and 10 of yokes 4 and 6 are inserted into respective bearings 26 and 30. Owing to elastic properties of an elastic plastic material, of which bearing pin 34,36 is formed, the slotted enlarged portion 36 of this pin is compressed in the radial direction and passes through the recess in projection 26, and after passing this projection, conical extension 36 is snapped behind projection 26, whereby an unreleaseable connection between base plate 2 and arm 10 of yoke 6 takes place.

FIG. 8 shows the pivoting connection between the base plate 2 and arm 8 of the suspension yoke 4. The supporting elements for the suspension yoke 4 are mirror-inverted in respect to the supporting elements of braking yoke 6 described with reference to FIG. 7. Bearing block 28*a* integrally formed with base plate 2 similarly to bearing block 28 shown in FIG. 9 has a recess 30*a* for receiving and supporting a pivot pin 32*a*, rigidly connected to arm 8 whereas projection 26*a* integrally formed with base plate 2 similarly to eyelet 26 for arm 10 of the braking yoke has a recess for supporting a pin 34*a* with an extension 36*a* and slot 38*a*, pin 39*a* being rigidly connected to the end face of arm 8 and being snapped in the recess of projection 26*a* in the fashion similar to that for the arm 10. Thus an unreleasable connection of both yokes 4 and 6 to base plate 2 is provided by the above-described supporting elements. The tape roll holder contains no losable parts and requires no additional fastening means, such as pins or screws, for assembling.

FIG. 14 shows a portion of shorter arm 10 of braking yoke 6 with the pin 34,36 pivotally supported in projection 26 of base plate 2. In this embodiment a narrower cyllindrical portion 50 is formed between the conical extension 36 and cylindrical portion 34 of the pin extended outwardly from arm 10. A helical spring 52 one end of which is supported against the lateral face of projection 26 surrounds cylindrical portion 50. This helical spring urges the braking yoke 6 to press towards the suspension yoke 4 so that the braking yoke 6 is pressed against the paper roll inserted into the holder with the force which exceeds its weight.

The fastening of the tape roll holder in position, for example, against the wall, is obtained either by self-glueing means applied to the back side of plate 2 or by bolts. Three or more connection bores as shown in FIG. 13 can be provided in the base plate for this purpose, of which one bore 48 can be formed in the middle of the lower portion of the base plate and may be circular, whereas two other bores 44,46 can be oblong and of which one bore 44 can extend horizontally and another bore 46 can extend vertically. Such an arrangement makes possible an exact vertical alignment of the holder with predrilled openings in the wall. As seen from FIG. 13 cutoffs are made in yokes 4 and 6 to show bores 44,46 and 48 in the base plate. After the base plate has been preliminary attached to the wall by means of bolts inserted into bores 44,46,48 and not shown herein the bolt inserted into circular bore 48 is rotated for a short period of time before final fastening of the other bolts unless the base plate is precisely adjusted in the horizontal direction. Then the bolts inserted into oblong openings 44 and 46 are tightly screwed into these openings and the base plate becomes finally fixed to the wall.

It is not required that the length of roll 14 should precisely correspond to the length of extension shaft 12 of yoke 4. Shorter rolls can be also utilized with the roll holder of the invention, without influencing the function of the holder. It is, of course, understandable that the tape roll holder of the invention can be manufactured for utilization as a toilet paper roll holder or a paper towel roll-holder, depending on the dimensions of the holder.

By provision of tooth-shaped projections or knife-shaped blades on the front arm of the yoke 6, a possibility can be made for separating an unperforated roll material. With reference to FIGS. 10 to 12 it will be seen the upper outer edge of free arm 16 of braking yoke 6 can be formed over its length with tooth-shaped blades or projections 40 extended in the upward direction as shown in FIGS. 10 and 11 or with knife-shaped blades 42 also extended in the upward direction, as shown in FIGS. 10 and 12, for easy tearing off paper web 20 from the remaining part of the roll. It is to be noted that the structure shown in FIG. 13 can be used with the embodiment of FIG. 10.

In use, paper web 20 is pulled out in the horizontal direction for rolling-off the roll 14. Upon this action, suspended yoke 4 moves some distance in the forward direction due to friction between the interior surface of roll 14 and outer surface of extension shaft 12 so that friction between the base plate 2 and roll 14 is reduced. The free arm 16 of braking yoke 6 forms an edge between paper roll 14 and the rolled-off paper web 20, so that paper roll 14 does not rotate by itself. Either easier or more difficult motion of the roll can be affected by a pulling force and in dependence on the direction of pulling which can be slightly upward or downward.

In order to tear paper web 20 off the roll, the web is pulled vertically downward so that paper roll 14 is pushed against base plate 2, whereby friction resistance is produced. Furthermore, braking yoke 6 presses against paper roll 14 from above to further increase the friction resistance. Due to the U-shaped cross-section of the free arm 16 of braking yoke 6, the paper warps on the braking edge of yoke 6 and thereby the braking action is increased by the closed shape of the yoke. The paper strip is, therefore, torn off while the paper roll is not rotating. Since extension shaft 12 and free arm 16 of yoke 6 are arranged at equal radial distance from the line of suspension, the braking action is maintained unless the unwinding of paper roll 14 is completed, while no clamping of roll 14 takes place between extension shaft 12 and braking yoke 6.

It will be understood that each of the elements described above, or two or more together, may also find a useful application in other types of roll holders differing from the types described above.

While the invention has been illustrated and described as embodied in a roll holder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt if for various applications without omitting features that, from the standpoint of prior art, fairly constitute essential characteristics of the generic or specific aspects of this invention.

What is claimed as new and desired to be protected by Letters Patent is set forth in the appended claims:

1. A roll holder, particularly for a roll of a flat product to be unrolled from the roll, comprising a base plate having an axis; a suspension yoke; and a braking yoke, each yoke being of U-shape cross-section and including a first arm extending in the direction of said axis of the base plate and pivotally supported thereon relative to said axis, and a second free arm, the free arm of said suspension yoke and the free arm of the braking yoke being positioned at an equal radial distance from said axis and overlapping each other, said suspension yoke and braking yoke having U-shaped lateral sides which are open in opposite directions.

2. The holder as defined in claim 1, wherein the free arm of said braking yoke includes a recess in which the free arm of said suspension yoke is insertable.

3. The holder as defined in claim 2, wherein the first arm of said suspension yoke and the first arm of said braking yoke are each shorter than the second free arm of each yoke and being positioned on said base plate in a common line one after another.

4. The holder as defined in claim 3, having an axis of symmetry and further including connecting pivot means for pivotally supporting the first arm of each yoke on said base plate, the connecting means of each yoke being positioned symmetrically to each other in respect to the axis of symmetry.

5. The holder as defined in claim 4, wherein the connecting pivot means of each yoke has two pivot points and include a first bearing formed in said base plate and located at one of said pivot points, a first bearing pin pivotally supported in said first bearing, a second bearing formed by a bearing block and located at said second pivot point, and a second bearing pin pivotally supported in said bearing block.

6. The holder as defined in claim 5, the first arm of each yoke having an inner end and an outer end in respect to said axis of symmetry, said first bearing pin being disposed at said inner end and said second bearing pin being disposed at said outer end.

7. The holder as defined in claim 6, wherein said bearing block has a cylindrical recess receiving said second bearing pin.

8. The holder as defined in claim 7, wherein said first bearing pin has a cylindrical portion received in said first bearing and a truncate-conical portion being of a greater diameter than that of the cylindrical portion and provided with a longitudinal slot extended centrally thereof up to a middle of said cylindrical portion, said truncate-conical portion passing through said first bearing and being engaged with said first bearing.

9. The holder as defined in claim 8, wherein said base plate is formed with an eyelet having a cylindrical recess and constituting said first bearing.

10. The holder as defined in claim 9, wherein the first arm of each yoke has an upper side formed with at least one cam-like projection, said base plate having a limiting rib, said projection of the first arm of each yoke being engageable with said rib.

11. The holder as defined in claim 10, wherein said base plate is formed with a trapezoidal rib provided in the region of said suspension yoke.

12. The holder as defined in claim 11, wherein said base plate is formed with three bores having central axes which are spaced from each other on said plate, one of said bores being circular and being spaced from two of said bores in a transverse direction of said base plate, and two of said bores being oblong with axes of elongation directed normally to each other.

13. The holder as defined in claim 11, wherein said braking yoke is biased by a spring in the direction toward said suspension yoke.

14. The holder as defined in claim 11, wherein the second free arm of the braking yoke has an outer side formed with a series of projections.

15. The holder as defined in claim 14, wherein said projections are tooth-shaped.

16. The holder as defined in claim 14, wherein said projections are knife-like blades.

* * * * *